United States Patent [19]

Lingl, Sr.

[11] 4,085,635

[45] Apr. 25, 1978

[54] WIRE BRICK CUTTER

[75] Inventor: Hans Lingl, Sr., Neu-Ulm, Ludwigsfeld, Germany

[73] Assignee: Lingl Corporation, Paris, Tenn.

[21] Appl. No.: 731,096

[22] Filed: Oct. 8, 1976

[30] Foreign Application Priority Data

Feb. 27, 1976 Germany ..... 2608041

[51] Int. Cl.[2] ..... B28B 11/14; B26D 1/10

[52] U.S. Cl. ..... 83/13; 83/168; 83/425.3; 83/435; 83/435.2; 83/620; 83/651.1

[58] Field of Search ..... 83/168, 425.3, 435, 83/435.2, 620, 651.1, 636, 644, 618, 427, 424, 425.2, 431

[56] References Cited

U.S. PATENT DOCUMENTS

| | | | |
|---|---|---|---|
| 1,316,056 | 9/1919 | Otto et al. | 83/168 |
| 1,670,233 | 5/1928 | Boisvert | 83/157 |
| 3,059,306 | 10/1962 | Hamilton | 83/425.3 X |
| 3,492,703 | 2/1970 | Bergling et al. | 83/425 |
| 3,838,621 | 10/1974 | Keck | 83/651.1 X |

*Primary Examiner*—Willie G. Abercrombie
*Attorney, Agent, or Firm*—Cushman, Darby & Cushman

[57] ABSTRACT

The invention relates to a method and apparatus for cutting clay columns, while continuously moving the clay columns in a generally horizontal direction. One or more clay columns are moved in a given generally horizontal direction A, prior to and during and subsequent to cutting. At least one cutting wire disposed in a generally vertical plane and disposed at an angle of substantially less than 90° with respect to the direction A is moved toward, into engagement with, and through the clay column while the clay column is continuously moved, to provide at least one cut through the column disposed in a plane that is parallel to a line extending in the direction A. The clay column is substantially rectangular in cross-section, and the wire is moved so that it moves at a diagonal through the column, first contacting the leading upper corner of the column, and last contacting the trailing lower corner of the column as it passes through the column. Material that adheres to the cutting wire(s) is automatically removed therefrom, collected, and re-used in forming another clay column.

10 Claims, 5 Drawing Figures

WIRE BRICK CUTTER

BACKGROUND AND SUMMARY OF THE INVENTION

The invention particularly relates to a method and apparatus for cutting face bricks from clay columns. In the past bricks have been cut from clay columns by pushing the column through a plurality of vertically extending cutting wires, such as shown in U.S. Pat. Nos. 3,461,196, and 3,602,963. Bricks formed by pushing column sections through stationary wires have ragged and sharp edges, and individuals handling the bricks can injure themselves by coming into contact with these ragged and sharp edges. Additionally, such as shown in U.S. Pat. No. 3,805,655, it has been known to mount cutting wires on a movable frame, and move the wires into contact with a stationary clay column. The movable frame can be pivotal about a pivot point located below the conveying surface on which the clay column rests. Such apparatus has a drawback of limited capacity since the clay columns must be cut while standing still, and since the bricks can be moved only after cutting is completed. Also, when the cutting frame is pivotal, exceptionally long wires and a high angular velocity must be employed (because of the conventional rectangular cross-section of the bricks), which significantly reduces the quality of the cut.

According to the present invention, the drawbacks inherent in the prior art are essentially avoided, clean cuts being made in the clay columns, and the bricks moving continuously during cutting so that a large output is provided. According to the method of the present invention, a clay column is moved in a given generally horizontal direction A, at least one cutting wire is disposed in a generally vertical plane at an angle of substantially less than 90° with respect to the direction A, and the cutting wire is moved toward, into engagement with, and through the clay column while the clay column is continuously moved in the direction A, to provide at least one cut through the column disposed in a plane that is parallel to a line extending in direction A. The wire is moved during cutting downwardly so that the wire moves through the column at a diagonal, first contacting the leading (in the direction of movement) upper corner of the column, and last contacting the trailing lower corner of the column (after passage through the column). The downward movement and the diagonal cut provides enough pressure on the column to avoid any slippage between the colum and the conveyor which is continuously moving the column, therefore a smooth, clean, cut is effected, no ragged and sharp edges remaining on the brick. The clay that adheres to the at least one wire is automatically removed from the wire after passage thereof through the clay column, and the removed clay is automatically collected and returned to an extruder 4 forming another clay column. After cutting, the bricks are continuously transported away from the cutting wire, and automatically disposed on loading pallets.

The apparatus for cutting conveyed articles according to the present invention includes a generally horizontally disposed conveyor system, including at least two continuous parallel conveyor belts spaced apart from each other a distance X in a direction transversed to the direction A in which the articles disposed on the conveyor belt are conveyed. Means are provided for powering the conveyor belts for movement of the articles disposed thereon in the direction A, means for mounting at least one cutting wire are provided so that the cutting wire extends in a generally vertical plane and is disposed at an angle substantially less than 90° with respect to the direction A, and so that it passes through the space between the conveyor belts, the at least one cutting wire having a horizontal dimension less than X, and means are provided for moving the at least one cutting wire mounting means so that said at least one cutting wire moves into engagement with and through an article continuously being moved by the conveyor belts in the direction A to provide at least one cut through the article disposed in a plane that is parallel to a line extending in direction A. The means for moving the wire mounting means comprises means for moving the wire mounting means downwardly during cutting by the wire, and includes a frame member for guiding downward movement of the mounting means, rotatable crank arm means, and means for rotating the crank arm means. Preferably a plurality of cutting wires are provided, and more than two conveyor belts are provided in the conveyor system, each belt being spaced from an adjoining belt at a distance greater than the corresponding dimension of the cutting wire cooperating with the space between the conveyor belts. A second conveyor system may be provided for moving articles onto the first conveyor system, a second conveyor system comprising at least three continuous parallel conveyor belts spaced apart from each other a horizontal distance Y, and at least two generally horizontally disposed rollers having a dimension less than Y, and means for selectively lowering the rollers into the spaces between the conveyor belts to dispose an article carried by the rollers on the conveyor belts. A third conveying system may be provided at the other end of the cutting apparatus to transport the cut bricks away from the cutting apparatus.

It is the primary object of the present invention to provide a high capacity method and apparatus for cutting clay columns into bricks, with the cuts formed being free of ragged and sharp edges. This and other objects of the invention will become apparent from an inspection of the detailed description of the invention, and from the appended claims.

DETAILED DESCRIPTION OF THE INVENTION

Figure 1:
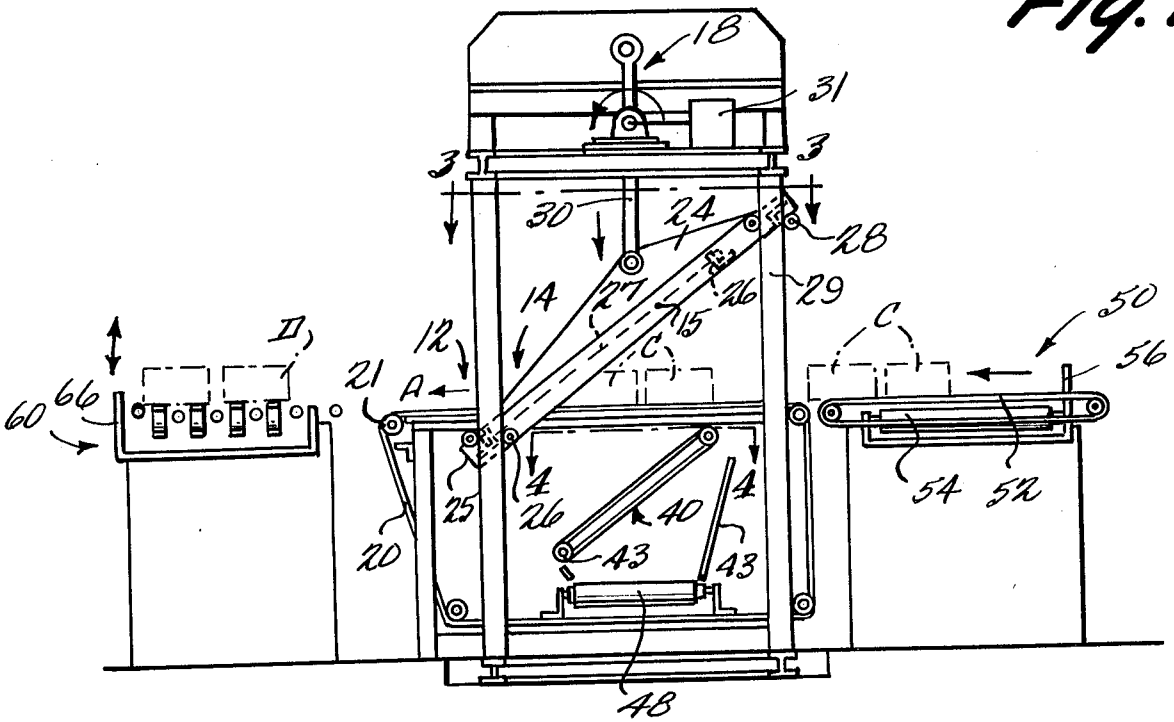
FIG. 1 is a side view of exemplary apparatus according to the present invention showing the cutting wires just beginning a cutting stroke.
Figure 5:
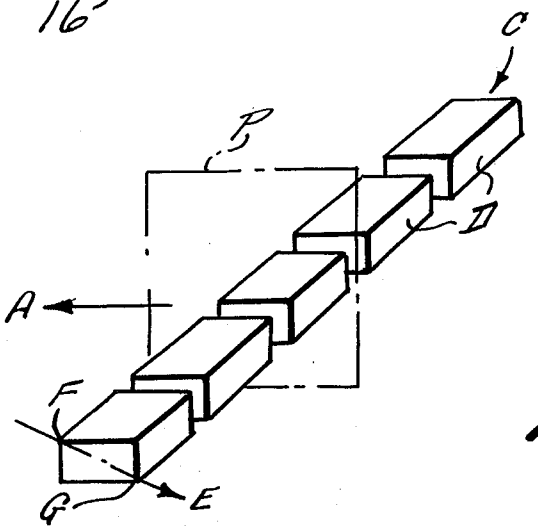
FIG. 5 is diagrammatic view of cut bricks according to the present invention, with the spaces therebetween being greatly exaggerated for clarity.

Exemplary apparatus according to the present invention, and for practicing the method of the present invention, is shown generally at 10 in FIG. 1. The apparatus is for cutting clay columns C or the like (generally having rectangular cross-sections) into individual face bricks (D - see FIG. 5). The apparatus includes a generally horizontally disposed first conveyor system 12, means 14 for mounting at least one cutting wire 15, so that it extends in a generally vertical plane and is disposed at an angle $\alpha$ of substantially less than 90° with respect to the direction A, means 16 for powering the first conveyor system for movement of articles disposed thereon in the direction A, and means 18 for moving the at least one cutting wire mounting means 14 so that the wire(s) 15 moves into engagement with and through a clay column C continuously being moved on the conveyor system 12, to provide at least one cut through the column C disposed in a plane that is parallel to a line extending in direction A.

Figure 2:
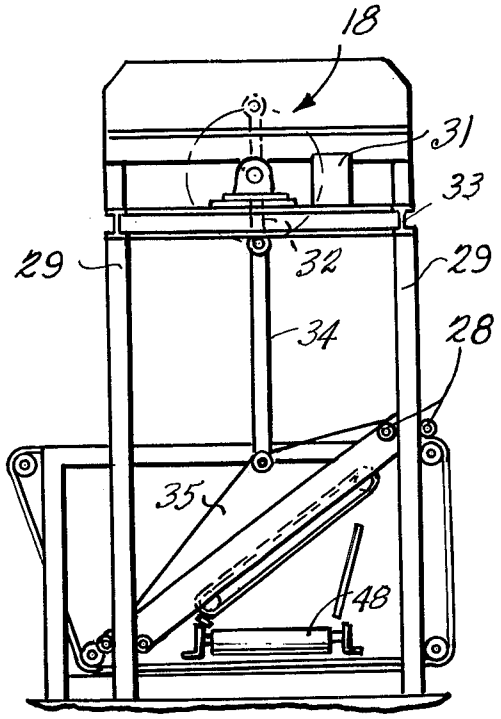
FIG. 2 is a side view of the cutting apparatus of FIG. 1 showing the cutting wires moving through a cutting cycle.

The first conveyor system 12 includes at least two continuous parallel conveyor belts 20 spaced apart from each other a distance X (see FIG. 2) transverse to the direction A, a motor or the like comprising the means 16 for rotating a roller 21 about which the conveyor belts 20 are disposed in order to transport clay columns C disposed thereon in the direction A. Each of the cutting wires 15 has a horizontal dimension less than the distance X between adjacent conveyor belts 20, so that a wire 15 may move vertically between adjacent conveyor belts 20.

The means 14 for mounting the cutting wires 15 includes a frame member 23 having one horizontally extending frame portion 25 thereof disposed vertically above the conveyors 20 while another horizontally extending frame portion 24 thereof is disposed below the conveyors 20, within the area defined by a loop of continuous conveyor belt 20. Mounting bars 26 attached to side frame members 27 of frame 23 hold the wires 15 taut. A plurality of rollers 28 mounted for rotation about horizontal axis are affixed to the frame 23 for engagement with vertically upstanding frame members 29 for guiding downward movement of the mounting means 14 during cutting.

The means 18 for moving the means 14 downwardly during cutting comprise the frame posts 29, rotatable crank arm means 30, and a motor 31 for rotating the crank arm means. As shown most clearly in FIGS. 1 and 2, the crank arm means comprise a first arm 32 pivotally mounted to a stationary member 33 and rotatable (under the influence of motor 31) with respect thereto, a crank arm 34 pivotally connected to the arm 32, and a plate 35 pivotally connected to the crank arm 34 and rigidly connected to the mounting 23. The length of the arm 32 may be changed to adjust the length of the downward cutting stroke.

Preferably, the angle is chosen with respect to the dimensions of a clay column C to be cut so that the wires 15 move throught the column C at a diagonal (E in FIG. 5), first contacting the leading (in the direction A of movement of the column C) upper corner F of the column, and last contacting the trailing lower corner G of the column C. In this way a very clean cut can be formed while the clay column C are continuously moved in direction A. The cuts that are formed are disposed in a plane P (see FIG. 5) that is parallel to a line extending in the direction A.

Figure 4:
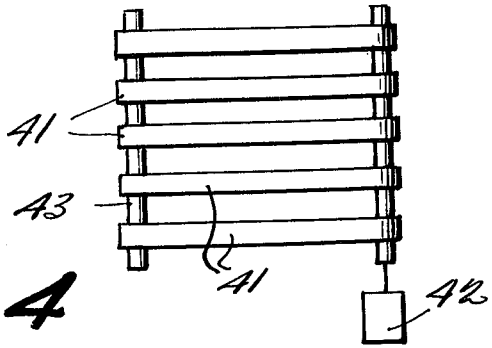
FIG. 4 is a top view of exemplary cutting wire cleaning means of FIG. 1, taken along lines 4—4 of FIG. 1.

Means 40 are provided for automatically removing clay that adheres to the wires 15 after cutting of the clay column C from the wires 15, after passage of the wires through the columns C. Such means 40, as shown most clearly in FIG. 4, may include a plurality of spaced belts 41 having bristles formed thereon, and powered by a motor 42 or the like, the bristles removing the clay from the wires 15, when the wires come in contact therewith (at the bottom point in the travel of arm 34 - see FIG. 2), the removed clay falling onto a conveyor belt 48 or the like, being guided during falling by plates 43, and being transported away automatically by continuously moving conveyor belt 48 or the like for recycle.

Figure 3:
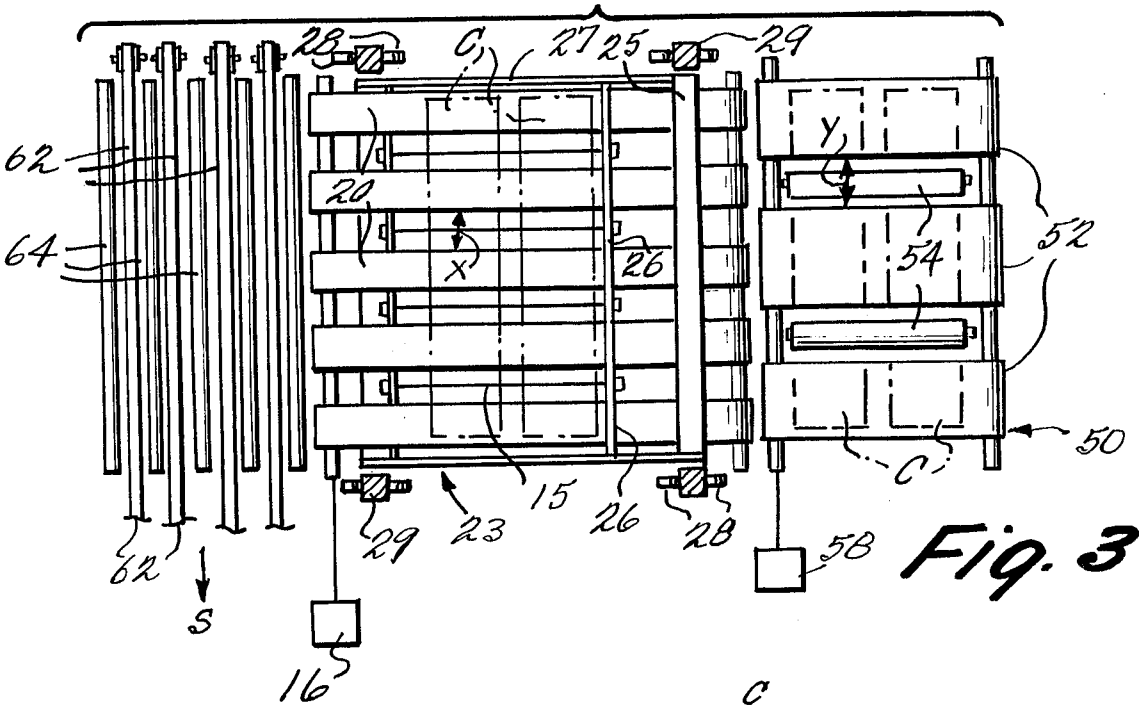
FIG. 3 is a top view taken along lines 3—3 of FIG. 1.

Any suitable means may be provided for transporting clay columns C onto the first conveyor system 12, such as a second conveyor system 50 as shown in FIGS. 1 and 3. The second conveyor system 50 includes at least three continuous parallel conveyor belts 52, spaced apart from each other a horizontal distance Y (see FIG. 3) and at least two generally horizontally disposed rollers 54 having a dimension less than Y. Means 56 (shown only diagrammatically in the drawings) are provided for mounting the rollers for rotation about a horizontal axis, and for selectively lowering the rollers into the spaces between the conveyor belts 52 to dispose a clay column C carried by the rollers onto the conveyor belts 52. The belts 52 can be continuously rotated by a motor 56 or the like, so that as soon as a new set of clay columns C are lowered onto the belts 52, they are immediately transferred to the first conveyor system 12 for cutting. Similarly, a third conveyor system 60 may be provided at the opposite end of the first conveyor system 12 from the second conveyor system 50, for removing cut bricks from the first conveying system 12.

The system 60 includes a plurality of spaced belts 62, and rollers 64 disposed in the spaces between the belts 62. The cut bricks D are transported from the conveyor system 12 by the rollers 64 into position on the belts 62, and after a number of bricks D have been disposed on the belts 62, the belts 62 are operated to transport the bricks D in direction S away from the system 12. Alternatively, means could be provided for transferring the cut bricks from first conveyor system 12 onto an assembly allowing direct transfer onto pallets, or onto a grouping conveyor of a setting machine for automatic facing, spacing, and placement onto kiln or platform cars for drying and firing of the bricks.

According to the present invention, a method for cutting clay columns is provided comprising the steps of moving a clay column C in a given generally horizontal direction A, disposing at least one cutting wire 15 in a generally vertical plane at an angle $\alpha$ of substantially less than 90° with respect to the direction A, moving at least one cutting wire 15 toward, into engagement with, and through the clay column C while continuously moving the clay column C in direction A, to provide at least one cut through the column disposed in a plane P that is parallel to a line extending in direction A. The wire moving step is preferably accomplished by moving at least one wire 15 in a given generally vertical direction B, generally perpendicular to the direction A, the direction B being generally downwardly. With the clay column C substantially rectangular in cross-section, the angle $\alpha$ is determined, and the moving step is accomplished so that the wire 15 moves through the column at a diagonal E, first contacting the leading upper corner F of the column, and last contacting the trailing lower corner G of the column C. It is apparent that more than one clay column C may be cut during each downward stroke of the cutting wires 15, it being necessary only to insure spacing between sets of columns C (which spacing is inherently provided by the apparatus 50 illustrated in the drawings) so that the wires are returned to an upward position for further cutting without interfering with the movement of other clay columns C to be cut during upward movement. A downward cutting stroke is more desirable than an upward cutting stroke since the clay columns C have less of a tendency to slide with respect to the conveyor belts 20 during downward cutting.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method for cutting clay columns comprising the steps of a. moving a clay column in a given generally horizontal direction A, b. disposing at least one cutting wire in a generally vertical plane at a fixed angle of substantially less than 90° with respect to said direction A, c. reciprocating the at least one cutting wire from a position out of contact with the clay column toward, into engagement with, and through the clay column while continuously moving the clay column in direction A, to provide at least one cut through the column disposed in a plane that is parallel to a line extending in direction A, by moving said at least one wire in a downward direction from generally above the clay column, toward, into engagement with, and to a position generally below the clay column, in a path wherein each point of the wire moves in a straight line, generally perpendicular to said direction A.

2. A method as recited in claim 1 comprising the further step of moving said at least one cutting wire upwardly to return it to a position for further cutting, without interfering with the movement of other clay columns to be cut.

3. A method as recited in claim 1 comprising the further step of automatically removing clay that adheres to said at least one wire from said wire after passage thereof through said clay column.

4. A method as recited in claim 3 comprising the further step of automatically collecting the clay removed from said at least one wire.

5. A method as recited in claim 1 wherein said clay column is substantially rectangular in cross-section, and wherein said fixed angle is chosen and wherein said wire moving step is accomplished so that the wire moves through the column at a diagonal, first contacting the leading upper corner in the direction of movement of the column and last contacting the trailing lower corner of the column.

6. Apparatus for cutting a conveyed article comprising a. a generally horizontal disposed conveyor system including at least two continuous parallel conveyor belts spaced apart from each other a distance X in a direction transverse to the direction A in which articles disposed on said conveyor belts are conveyed, b. means for mounting at least one cutting wire so that it extends in a generally vertical plane and is disposed at a fixed angle of substantially less than 90° with respect to said direction A, and so that it passes through the space between said conveyor belts, said at least one cutting wire having a horizontal dimension less than X, c. means for powering said conveyor belts for movement of articles disposed thereon in said direction A, d. means for moving said at least one cutting wire mounting means so that at least one cutting wire moves from a position above an article downwardly toward and into engagement with and through an article continuously being moved by said conveyor belts in said direction A to provide at least one cut through the article disposed in a plane that is parallel to a line extending in direction A, and e. means for guiding the movement of said at least one cutting wire mounting means so that it is reciprocal, each point of said at least one cutting wire moving in a straight line, generally perpendicular to said direction A, during movement of said at least one cutting wire toward, into engagement with, and through an article on said conveyor belts.

7. Apparatus as recited in claim 6 further comprising means for automatically removing material that adheres to said wire after cutting of an article therewith from said wire after passage of said wire through said article.

8. Apparatus as recited in claim 7 further comprising means for automatically collecting the material removed from said wire.

9. Apparatus as recited in claim 6 wherein said guiding means comprise a plurality of vertically upstanding frame members, and a plurality of rollers straddling each of said frame members and in operative engagement therewith.

10. Apparatus as recited in claim 9 wherein said means for moving said wire mounting means comprises rotatable crank arm means and means for rotating said crank arm means.

* * * * *